US012516902B1

(12) United States Patent
Drew et al.

(10) Patent No.: US 12,516,902 B1
(45) Date of Patent: Jan. 6, 2026

(54) LOAD BALANCED FIREARM BARREL EXTENSION

(71) Applicant: Knight's Armament, LLC, Titusville, FL (US)

(72) Inventors: Joshua R. Drew, Orlando, FL (US); C. Reed Knight, Jr., Titusville, FL (US); David B. Kowalski, Cocoa, FL (US)

(73) Assignee: Knight's Armament, LLC, Titusville, FL (US)

( * ) Notice: Subject to any disclaimer, the term of this patent is extended or adjusted under 35 U.S.C. 154(b) by 713 days.

(21) Appl. No.: 17/937,032

(22) Filed: Sep. 30, 2022

(51) Int. Cl.
*F41A 21/12* (2006.01)
*F41A 3/30* (2006.01)

(52) U.S. Cl.
CPC ..... *F41A 21/12* (2013.01); *F41A 3/30* (2013.01)

(58) Field of Classification Search
CPC ..... F41A 3/26; F41A 3/30; F41A 21/12
See application file for complete search history.

(56) References Cited

U.S. PATENT DOCUMENTS

| | | | | |
|---|---|---|---|---|
| 5,911,173 | A | 6/1999 | Westrom | |
| 6,182,389 | B1 * | 2/2001 | Lewis | F41A 3/26 89/185 |
| 6,484,430 | B1 * | 11/2002 | Robinson | F41A 3/26 42/25 |
| 6,609,319 | B1 * | 8/2003 | Olson | F41A 15/14 89/185 |
| 9,234,713 | B1 * | 1/2016 | Olson | F41A 9/41 |
| 9,448,020 | B1 * | 9/2016 | Olson | F41A 3/66 |
| 9,863,729 | B2 | 1/2018 | Blank | |
| 9,921,019 | B2 * | 3/2018 | Stone | F41A 21/481 |
| 11,092,396 | B1 * | 8/2021 | Sugg | F41A 9/55 |
| 2005/0188590 | A1 * | 9/2005 | Baber | F41A 21/12 42/75.02 |
| 2012/0055058 | A1 | 3/2012 | Picard et al. | |
| 2014/0075806 | A1 * | 3/2014 | Blank | F41A 3/30 42/25 |
| 2015/0260467 | A1 * | 9/2015 | Blank | F41A 3/30 42/25 |
| 2016/0010938 | A1 | 1/2016 | Merkley et al. | |
| 2017/0321978 | A1 * | 11/2017 | Brannan | F41A 3/70 |
| 2022/0252369 | A1 * | 8/2022 | Geissele | F41A 21/12 |
| 2022/0299280 | A1 * | 9/2022 | Sunseri | F41A 21/487 |
| 2024/0044598 | A1 * | 2/2024 | Smieja | F41A 21/482 |

FOREIGN PATENT DOCUMENTS

| | | | | |
|---|---|---|---|---|
| EP | 4425089 | A1 * | 9/2024 | F41A 3/58 |

* cited by examiner

*Primary Examiner* — Gabriel J. Klein
(74) *Attorney, Agent, or Firm* — Woodard, Emhardt, Henry, Reeves & Wagner, LLP

(57) ABSTRACT

A barrel extension configured to reduce the likelihood of premature bolt failure in automatic and/or semi-automatic style weapons. The barrel extension includes one or more cutouts within a body of the barrel extension. The cutouts are configured to reduce rigidity of the barrel extension proximal to the location of the cutout. As the rigidity around the extractor is lowered, the force on the bolt lugs is more evenly distributed. In one example, the cutouts are in the form of a single oval cutout positioned adjacent an extractor of the bolt.

34 Claims, 18 Drawing Sheets

LOAD BALANCED FIREARM BARREL EXTENSION

BACKGROUND

Firearms are commonly used by police officers, military members, and recreational shooters. These individuals depend on the firearm to be safe and reliable when in use. Unfortunately, firearms, such as automatic and/or semi-automatic style firearms commonly experience premature bolt failure, which reduces the reliability and/or safety of the weapon.

Thus, there is a need for improvement in this field.

SUMMARY

A unique barrel extension has been developed for use with firearms. Specifically, the barrel extension is developed to reduce the likelihood of premature bolt failure in automatic and/or semi-automatic style weapons. For example, AR-15 style weapons. Reducing the likelihood of bolt failure is helpful for both civilian and military applications. For example, reducing bolt failure increases weapon reliability and safety.

Typically, a barrel extension is mounted to an end of a barrel proximal to a shooter when firing. The barrel extension includes a body having a barrel engagement end and a bolt engagement end. The barrel engagement end is mounted to the end of the barrel via one or more threads. For example, the barrel extension is attached to the end of the barrel via a threaded connection. The bolt engagement end of the barrel extension includes one or more circumferential protrusions and/or teeth configured to interact with one or more circumferential lugs of a bolt of the firearm. Generally, the bolt lugs and the extension teeth are configured to lock together during firing and to unlock after firing to eject the spent round. Between the barrel engagement and bolt engagement ends of the barrel extension on the exterior of the extension is a circumferential ridge. The ridge is sandwiched between a barrel nut and an upper receiver when mounting the barrel to the upper receiver of the firearm. On the interior of the barrel extension and between the first and second ends is a chamber. In one embodiment, the chamber is known as the star chamber due to the circumferential teeth. Combustion and firing of the round happens within the chamber. After combustion, a portion of the combustion gasses travel back into the bolt and/or bolt carrier group and force the bolt lugs and the extension teeth to unlock. As the bolt travels rearward (towards a shooter), an extractor grabs the spent casing and ejects the spent round.

Typically, bolt failure occurs during combustion at the bolt lugs. For example, the bolt lugs may shear off completely during firing. Specifically, the lugs on either side of the extractor and/or extractor lug are the most prone to failure. The designed barrel extension includes one or more cutouts within the extension body to reduce rigidity of the extension so that force is more evenly distributed on the corresponding bolt lugs. In one example, the cutouts are in the form of a single oval cutout positioned proximal to the extractor. In another example, the cutouts are in the form of a pair of cutouts positioned proximal to the extractor. The cutouts are configured to reduce rigidity of the barrel extension proximal to the location of the cutout. As the rigidity around the extractor is lowered, the force on the bolt lugs is more evenly distributed. As should be appreciated, evenly distributing the force to each of the bolt lugs reduces the likelihood of failure. This configuration is counter to conventional methods of reducing bolt failure. For example, conventional methods of reducing bolt failure include strengthening and/or adding material to the barrel extension and or bolt lugs. However, with the configuration described above, the barrel extension is strategically weakened in order to mitigate bolt failure and/or increase bolt life.

The system and techniques as described and illustrated herein concern a number of unique and inventive aspects. Some, but by no means all, of these unique aspects are summarized below.

Aspect 1 generally concerns a system.

Aspect 2 generally concerns the system of any previous aspect including a firearm.

Aspect 3 generally concerns the system of any previous aspect including a breech assembly.

Aspect 4 generally concerns the system of any previous aspect including a barrel.

Aspect 5 generally concerns the system of any previous aspect including a bolt.

Aspect 6 generally concerns the system of any previous aspect including an extractor that has an extractor lug.

Aspect 7 generally concerns the system of any previous aspect including a barrel extension.

Aspect 8 generally concerns the system of any previous aspect including a firearm breech for reducing premature failure of a bolt.

Aspect 9 generally concerns the system of any previous aspect including cutouts that are positioned proximal to a pair of lugs of the bolt.

Aspect 10 generally concerns the system of any previous aspect in which the bolt has the pair of lugs located adjacent the extractor lug.

Aspect 11 generally concerns the system of any previous aspect in which the barrel has a breech end.

Aspect 12 generally concerns the system of any previous aspect in which the bolt has at least one extractor lug.

Aspect 13 generally concerns the system of any previous aspect in which the bolt has an extractor.

Aspect 14 generally concerns the system of any previous aspect in which the cutouts are positioned proximal to the extractor lug.

Aspect 15 generally concerns the system of any previous aspect in which the barrel extension reduces premature failure of the bolt.

Aspect 16 generally concerns the system of any previous aspect in which the barrel extension removably mounted to the breech end of the barrel.

Aspect 17 generally concerns the system of any previous aspect in which the barrel extension includes one or more teeth configured to interact with one or more lugs of the bolt.

Aspect 18 generally concerns the system of any previous aspect in which the barrel extension teeth and bolt lugs interact to form a positive lock when in a closed position.

Aspect 19 generally concerns the system of any previous aspect in which the barrel extension includes one or more chamfered edges configured to guide the bolt into the barrel extension.

Aspect 20 generally concerns the system of any previous aspect in which the barrel extension has one or more teeth configured to engage one or more lugs of a bolt.

Aspect 21 generally concerns the system of any previous aspect in which the barrel extension has one or more weakened areas configured to reduce a risk of shearing at least one of the lugs of the bolt.

Aspect 22 generally concerns the system of any previous aspect in which the barrel extension includes one or more weakened areas configured to make the barrel extension have an asymmetric rigidity relative to a longitudinal axis of the barrel extension.

Aspect 23 generally concerns the system of any previous aspect in which the weakened areas are configured to reduce the rigidity of the barrel extension proximal to the lugs of the bolt.

Aspect 24 generally concerns the system of any previous aspect in which the weakened areas are configured to reduce shear force on the lugs of the bolt proximal to an extractor during firing.

Aspect 25 generally concerns the system of any previous aspect in which the barrel extension defines one or more cutouts configured to decrease a risk of failure of the bolt.

Aspect 26 generally concerns the system of any previous aspect in which the barrel extension includes one or more weakened areas configured to reduce rigidity of the barrel extension.

Aspect 27 generally concerns the system of any previous aspect in which the weakened areas are configured to evenly distribute shear force to each lug of the bolt.

Aspect 28 generally concerns the system of any previous aspect in which the weakened areas include one or more cutouts in the barrel extension.

Aspect 29 generally concerns the system of any previous aspect in which the cutouts have an oval shape.

Aspect 30 generally concerns the system of any previous aspect in which the cutouts are positioned proximal to at least one extractor lug of the bolt.

Aspect 31 generally concerns the system of any previous aspect in which the cutouts include a pair of cutouts.

Aspect 32 generally concerns the system of any previous aspect in which the cutouts are positioned proximal to a pair of lugs of the bolt located adjacent the extractor lug.

Aspect 33 generally concerns the system of any previous aspect in which the bolt configured to selectively engage with the barrel extension during operation of a firearm.

Aspect 34 generally concerns the system of any previous aspect in which the cutouts are configured to make the barrel extension have an asymmetric rigidity relative to a longitudinal axis of the barrel extension.

Aspect 35 generally concerns the system of any previous aspect in which the bolt defines a channel.

Aspect 36 generally concerns the system of any previous aspect in which the extractor received in the channel of the bolt.

Aspect 37 generally concerns the system of any previous aspect in which the bolt has a pair of lugs located on opposite sides of the channel.

Aspect 38 generally concerns the system of any previous aspect in which the cutouts are positioned to face the channel in the bolt.

Aspect 39 generally concerns the system of any previous aspect in which the cutouts include a single cutout.

Aspect 40 generally concerns the system of any previous aspect in which the single cutout spans across the pair of lugs.

Aspect 41 generally concerns the system of any previous aspect in which the cutouts are configured to evenly distribute shear force to each lug of the bolt.

Aspect 42 generally concerns a method of operating the system of any previous aspect.

Further forms, objects, features, aspects, benefits, advantages, and embodiments of the present invention will become apparent from a detailed description and drawings provided herewith.

DETAILED DESCRIPTION OF SELECTED EMBODIMENTS

Figure 1:
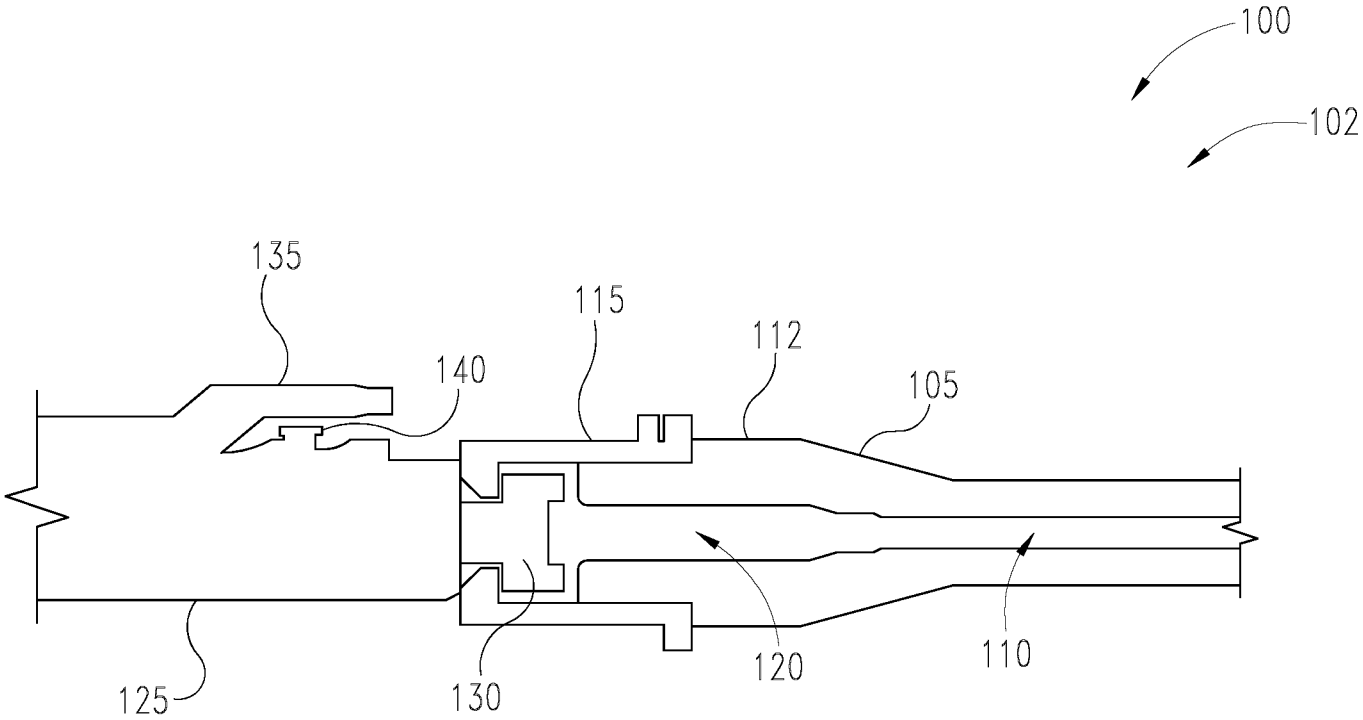
FIG. 1 is a diagrammatic view of components of a breech assembly of a firearm.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "100" series reference numeral will likely first appear in FIG. 1, an element identified by a "200" series reference numeral will likely first appear in FIG. 2, and so on.

FIG. 1 shows an example of a breech assembly 102 of a firearm 100. For example, an automatic, semi-automatic, bolt action, lever action, and/or other firearm. The firearm 100 includes a barrel 105 with a central bore 110. In one example, the barrel 105 is made from metal and/or a metallic material. In another example, the barrel 105 is made from a carbon fiber material. As should be appreciated, the diameter of the bore 110 is different for different caliber firearms.

At a breech end 112 of the barrel 105, a barrel extension 115 is secured to the barrel 105. The barrel extension 115 and the breech end 112 of the barrel 105 define a portion of a breech 120. The breech 120 is configured to retain a cartridge and/or round during firing. In one example, the barrel extension 115 mounts to the breech end 112 of the barrel 105 via a threaded connection. In another example, the barrel extension 115 and the breech end 112 of the barrel 105 are connected via one or more welds to form a unitary component. In yet another example, the barrel extension 115 and the barrel 105 are cast and/or molded as a single unitary component.

A bolt carrier 125 is configured to retain a bolt 130 of the firearm 100. The bolt 130 is configured to lock the breech 120 closed during firing. The bolt 130 is further configured to feed cartridges into the breech 120. Additionally, the bolt 130 includes a firing pin, which is configured to enable firing of the firearm 100. The bolt carrier 125 further includes a gas key 135 and a cam pin 140. The gas key 135 is configured to enable combustion gasses from firing of the firearm 100 to unlock the bolt 130 from the barrel extension 115. Typically, gas key 135 is found on gas impingement style firearms. The cam pin 140 is configured to guide and/or elicit rotation of the bolt 130 to lock and/or unlock the bolt 130. For example, the cam pin 140 is configured to follow a predetermined track set within the bolt carrier 125. In one example, the cam pin 140 creates about 15 degrees of rotation in the bolt 130.

Figure 2:
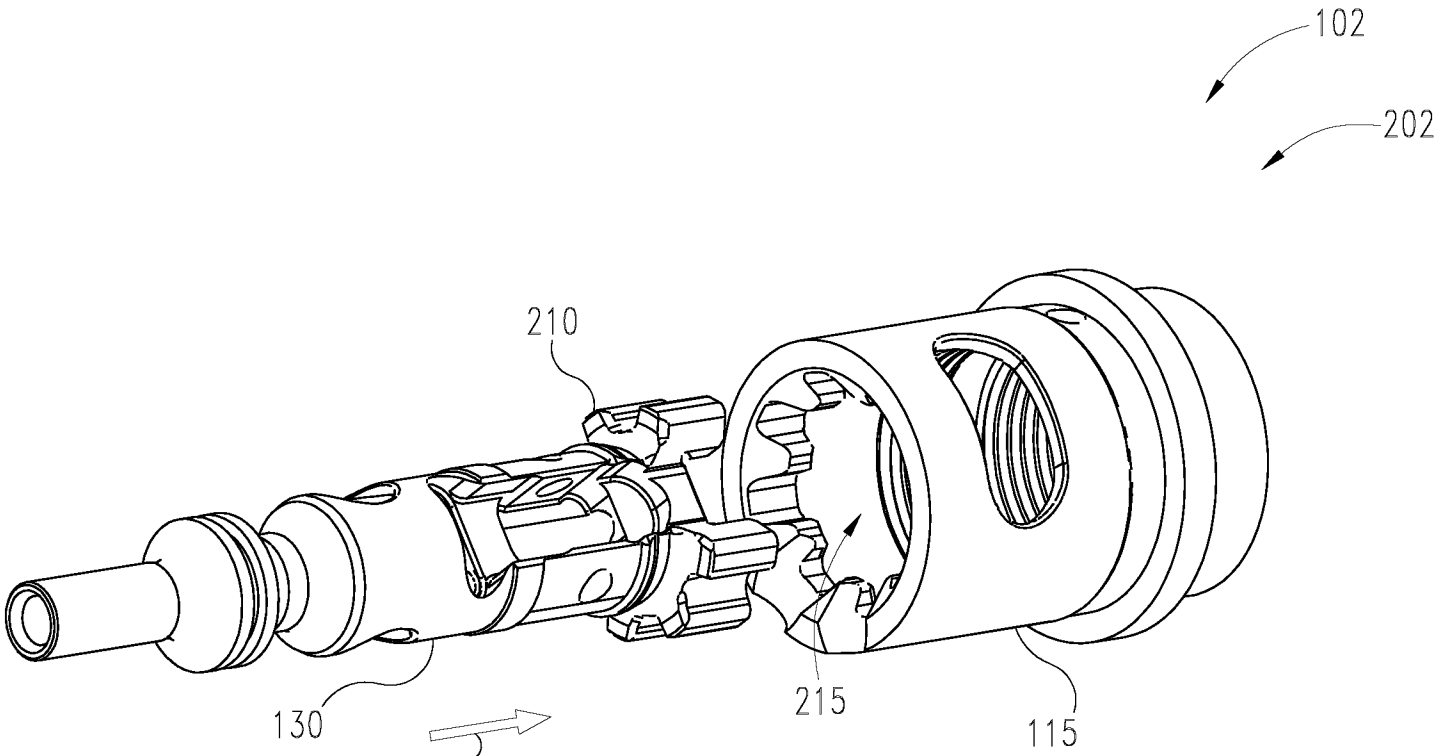
FIG. 2 is a perspective view of the breech assembly in an unlocked position.

FIG. 2 shows an example of the breech assembly 102 in an unlocked position 202. In the unlocked position 202, the bolt 130 is separated from the barrel extension 115. As indicated by arrow 205 a bolt head 210 of the bolt 130 is configured to slide through an opening 215 of the barrel extension 115 to move the bolt 130 into the locked position. In some examples, the bolt 130 is configured to load a cartridge into the breech 120 when moving from the unlocked position 202 into the locked position. For example, after firing a projectile the bolt 130 is configured to move into the unlocked position 202 and eject the spent casing of the cartridge during rearward motion of the bolt 130. However, on forward motion of the bolt 130, as shown by arrow 205, the bolt 130 is configured to load a new cartridge into the breech 120.

Figure 3:
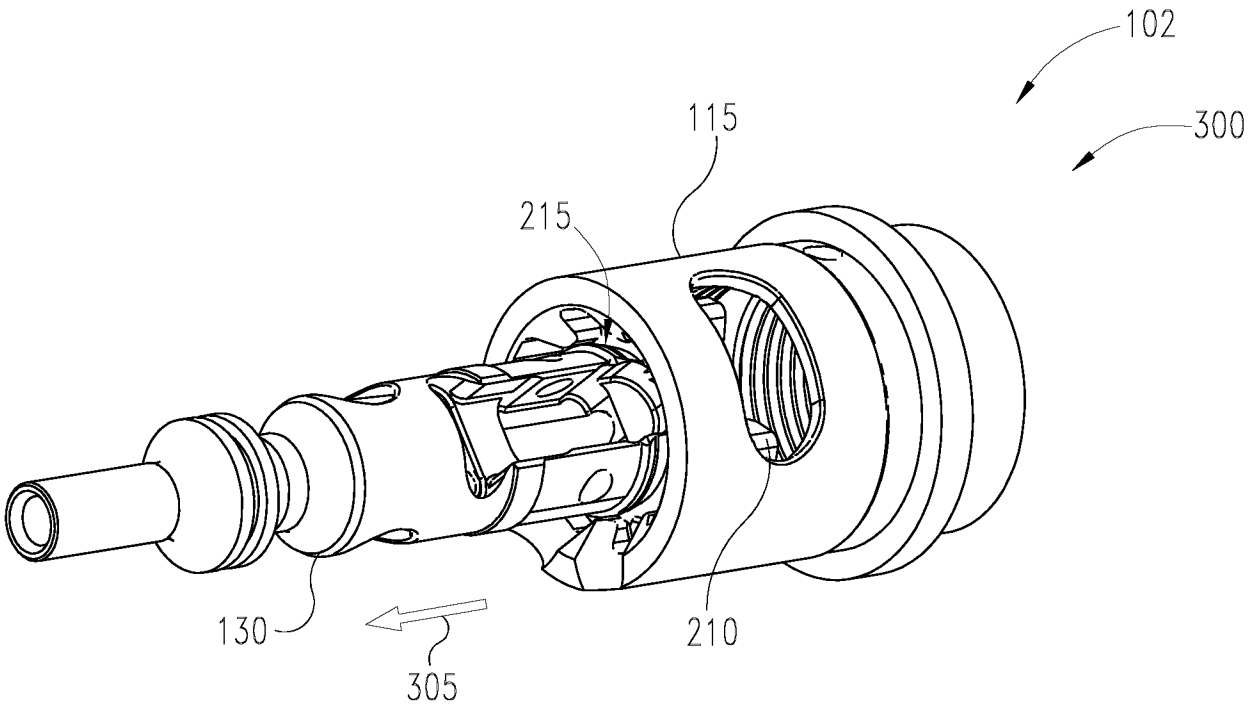
FIG. 3 is a perspective view of the breech assembly of FIG. 2 in a locked position.

FIG. 3 shows an example of the breech assembly 102 in a locked position 300. In the locked position 300, the bolt head 210 extends through the opening 215 of the barrel extension 115. In the locked position 300, the breech 120 is locked such that firing of a projectile is contained within the breech 120. In one example, after firing of the projectile, the combustion gasses flow into the gas key 135 and cause the cam pin 140 to begin to create rotation in the bolt 130. In some examples, 15-degree rotation of the bolt 130 unlocks the bolt 130 from the barrel extension 115. However, in other examples, less than 15-degree rotation and/or greater than 15-degree rotation unlocks the bolt 130 from the barrel extension 115. After the bolt 130 is unlocked, the bolt 130 moves as shown by arrow 305 to eject the spend casing and prepare to load a new cartridge.

Figure 4:
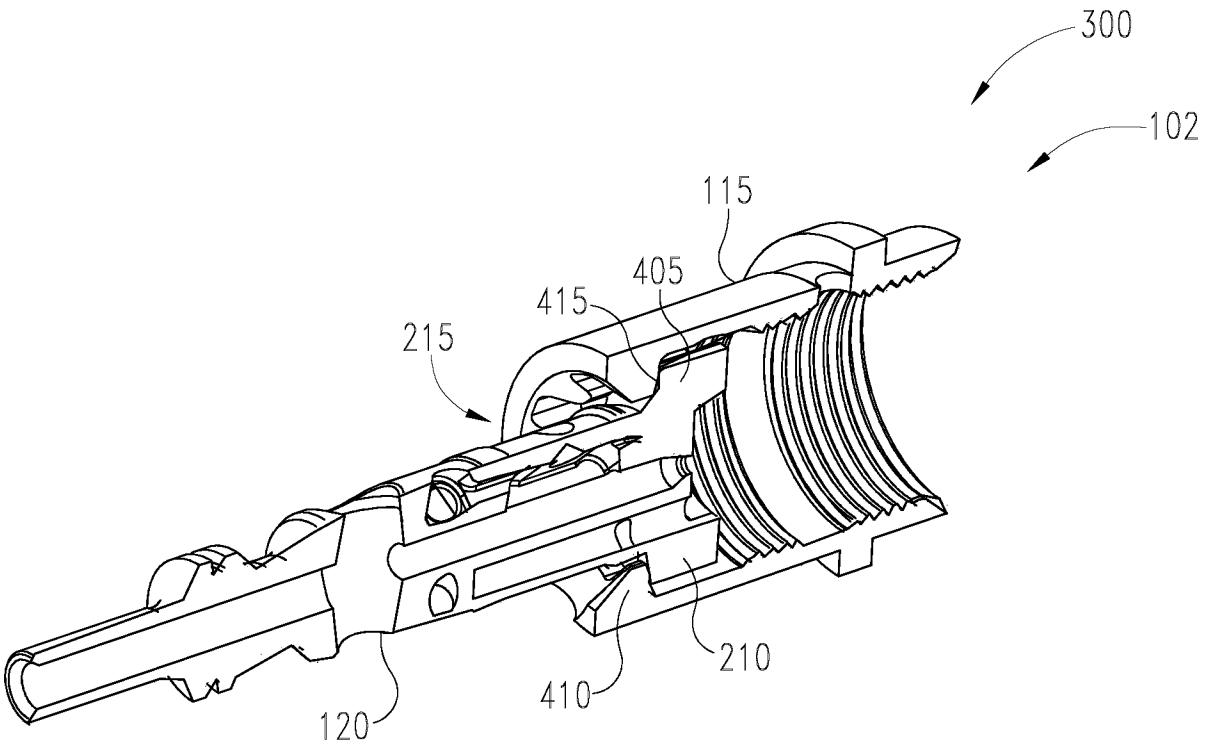
FIG. 4 is a cross-sectional view of the breech assembly of FIG. 2 in the locked position.
Figure 5:
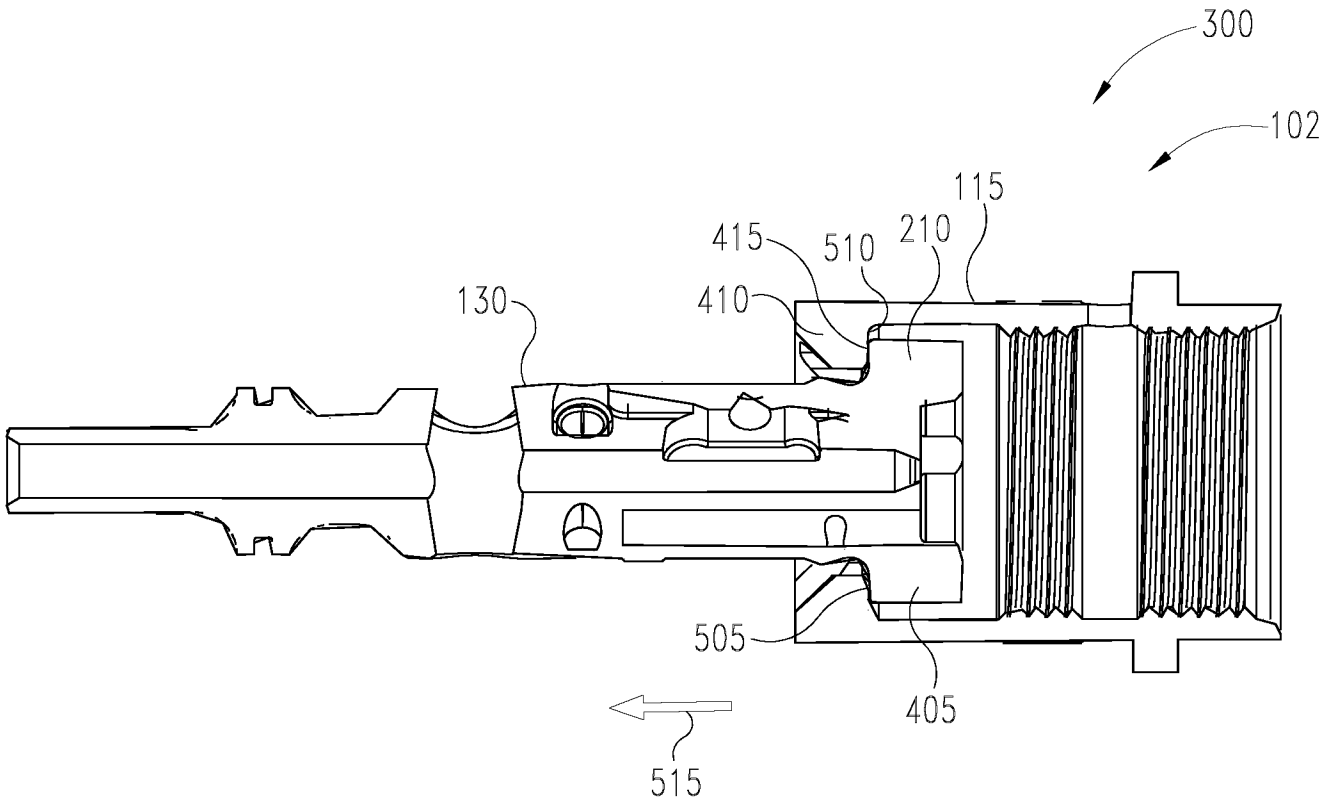
FIG. 5 is a cross-sectional view of the breech assembly of FIG. 2 in the locked position.

FIGS. 4 and 5 show cross-sectional views of the breech assembly 102 in the locked position 300. In the locked position 300, the bolt 130 locks into the barrel extension 115 via one or more lugs 405. The barrel extension 115 is shown to include one or more teeth 410. The teeth 410 are configured to interact with the lugs 405 to form a positive lock 415. The positive lock 415 between the bolt 130 and the barrel extension 115 is configured to prevent rearward movement of the bolt 130 during firing of a projectile. As should be appreciated, rotation of the bolt 130 moves the lugs 405 and the teeth 410 out of alignment to enable the bolt 130 to slide through the opening 215 of the barrel extension 115. The lugs 405 further include an engagement face 505 configured to contact a locking face 510 of the teeth 410 when in the locked position 300. For example, during firing, combustion gasses expand and apply force to the bolt 130 in the direction shown by arrow 515. The force applied to the bolt 130 forces the engagement face 505 of the lugs 405 into the locking face 510 of the teeth 410, thus preventing movement of the bolt 130 during firing. As should be appreciated, the force applied to the bolt 130 via the combustion gasses creates extreme stress on the lugs 405, thus leading to a potential for bolt failure.

Figure 6:
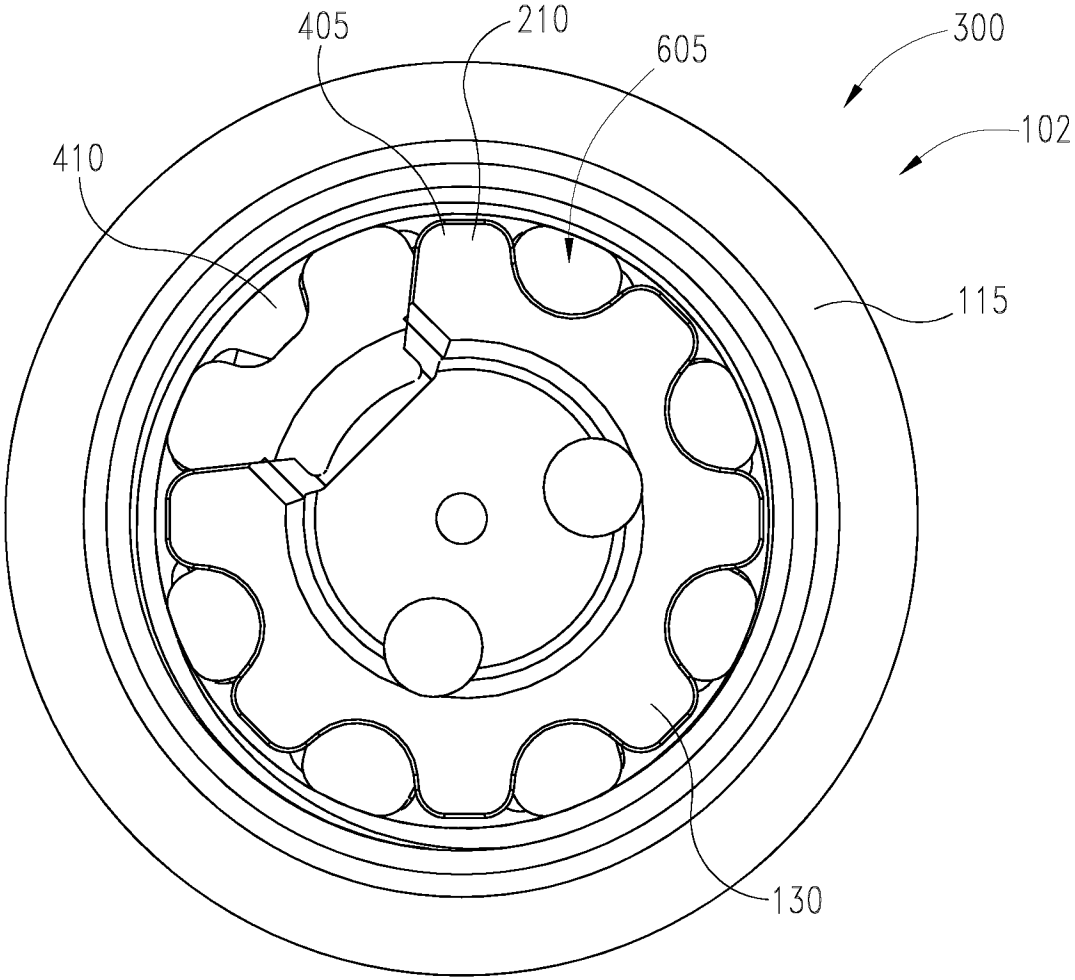
FIG. 6 is an enlarged end view of the breech assembly of FIG. 2 in the locked position.

As shown in FIG. 6, the bolt 130 is configured to slide into and/or out of the barrel extension 115 via one or more notches 605. The notches 605 enable the lugs 405 of the bolt 130 to bypass the teeth 410 of the barrel extension 115. For example, rotation generated in the bolt 130 via the cam pin 140 slides the engagement face 505 across the locking face 510 until the lugs 405 align with the notches 605. At this stage, the bolt 130 is able to slide out of the barrel extension 115. In another example, once the lugs 405 move past the teeth 410 rotation of the bolt 130 locks the lugs 405 into position behind the teeth 410 as the engagement face 505 slide across the locking face 510 into the locked position 300. As should be appreciated, after firing, the bolt 130 rotates and the engagement face 505 of the lugs 405 slide out of alignment with the locking face 510 of the teeth 410 and exit the barrel extension 115 via the notches 605.

The lugs 405 define a roughly arcuate shape without any sharp edges. For example, the lugs 405 do not include any 90-degree edges. As should be appreciated, the beveled edges of the lugs 405 enable the lugs 405 to better slide into position within the barrel extension 115. The teeth 410 define an arcuate shape configured without any sharp edges. For example, the teeth 410 define a rounded and/or semi-circular shape. The rounded shape assists in guiding the lugs 405 of the bolt 130 into the opening 215.

Figure 7:
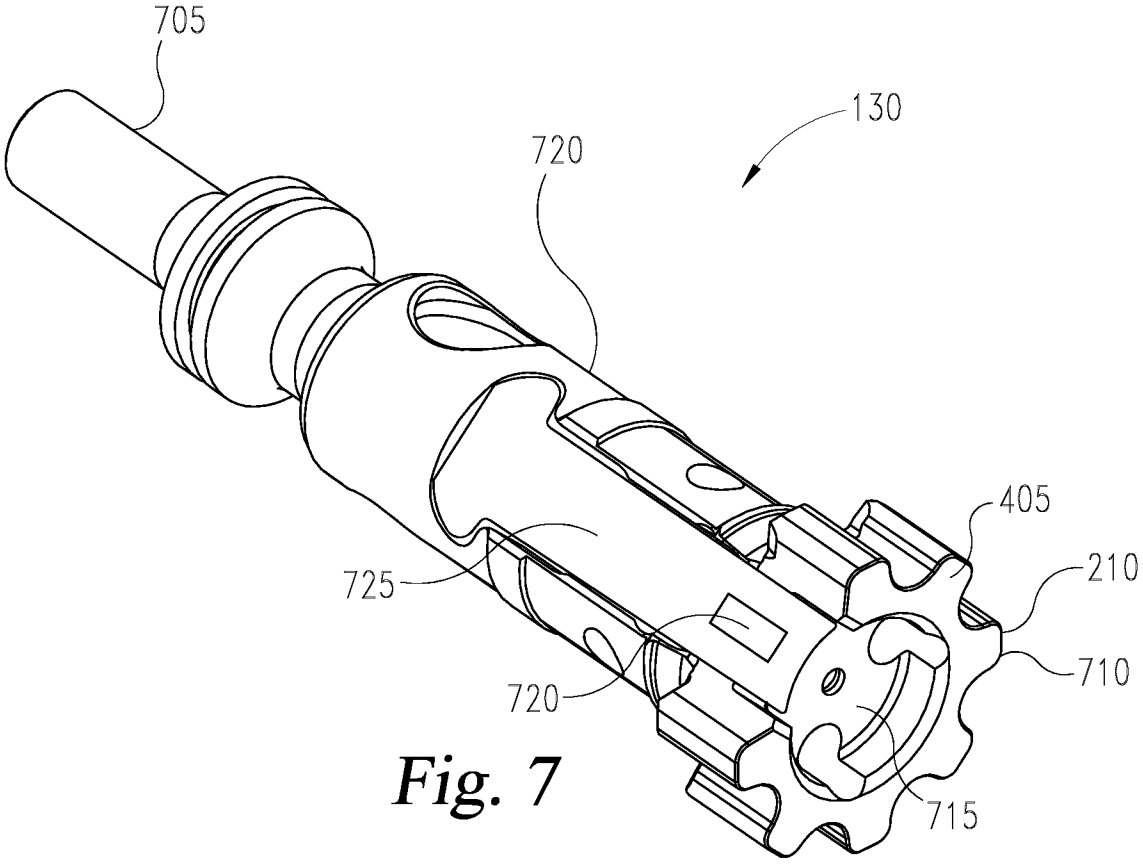
FIG. 7 is a perspective view of a bolt of the breech assembly of FIG. 2.

FIG. 7 shows an example of the bolt 130. The bolt 130 includes a bolt carrier end 705 and a barrel extension end 710. The bolt carrier end 705 is configured to nest within the bolt carrier 125. The barrel extension end 710 includes the bolt head 210 and is configured to enter the barrel extension 115. Located at the barrel extension end 710 is a bolt face 715. The bolt face 715 is configured to retain a base of the cartridge. The area between the bolt carrier end 705 and the barrel extension end 710 defines a body 720. The body 720 includes an extractor 725. The extractor 725 is configured to remove a spent casing from the breech 120 after firing. In some examples, the extractor 725 includes an extractor lug 730 configured to interact with the teeth 410 of the barrel extension 115.

Figure 8:
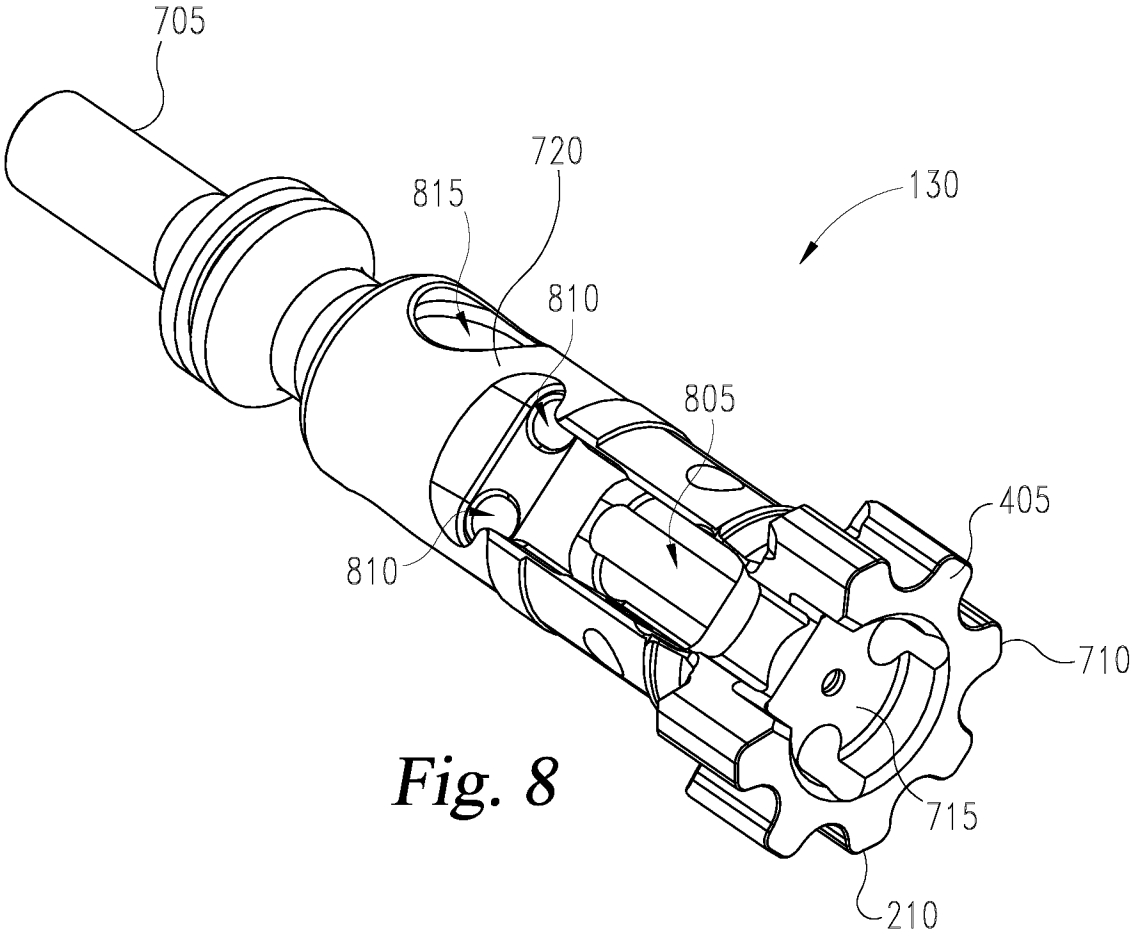
FIG. 8 is a perspective view of the bolt of FIG. 7 without an extractor.

FIG. 8 shows another example of the bolt 130 with the extractor 725 removed. The body 720 of the bolt 130 includes a channel 805 configured to receive the extractor 725. The channel 805 includes one or more apertures 810. The apertures 810 are configured to retain a biasing element, such as a spring. The body 720 further includes a slot 815. The slot 815 is configured to receive the cam pin 140.

Figure 9:
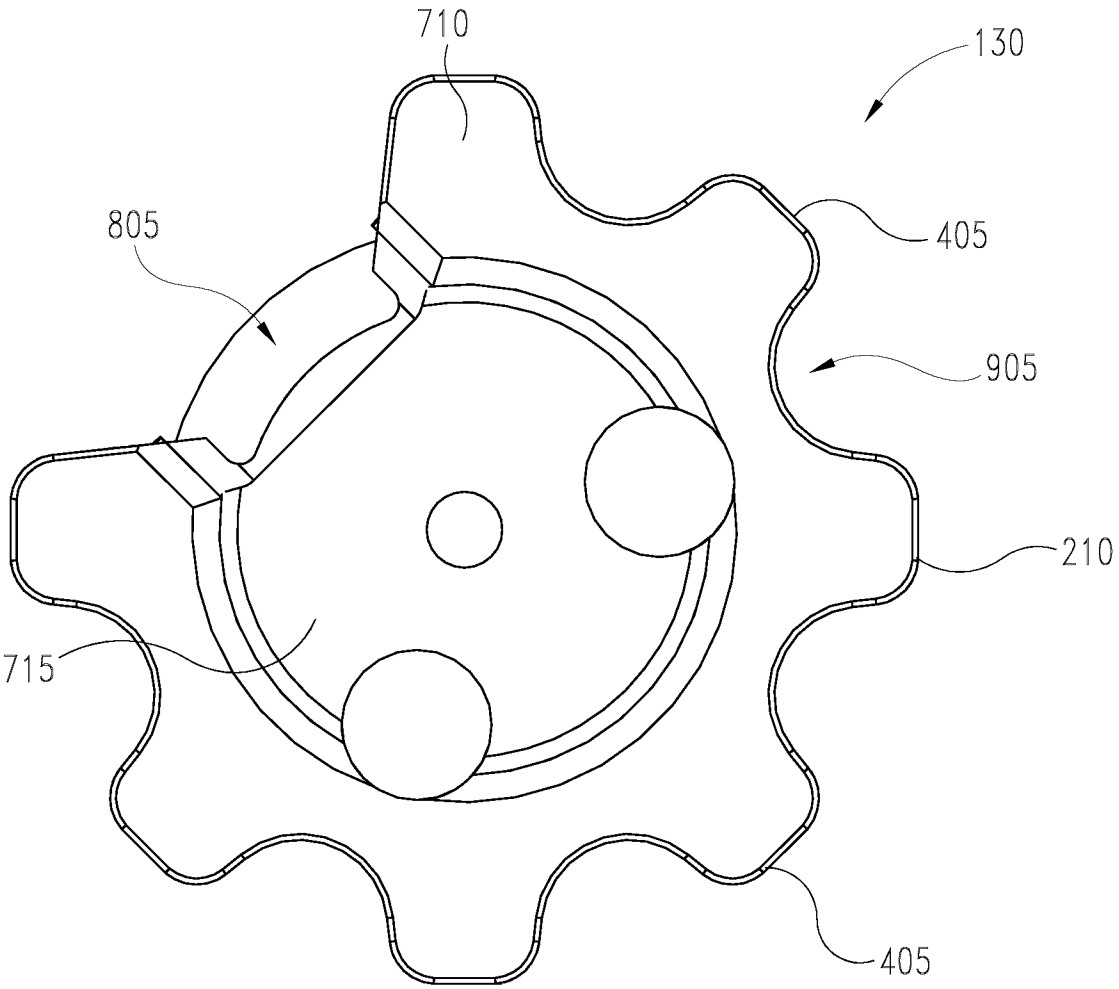
FIG. 9 is an enlarged end view of the bolt of FIG. 7.

FIG. 9 shows an end view of the bolt 130. As can be seen, the lugs 405 are circumferentially disposed around the bolt head 210. Each lug 405 is separated from adjacent lugs 405 via a groove 905. As should be appreciated, the grooves 905 are configured to enable the bolt 130 to pass through the teeth 410 of the barrel extension 115. In one example, the bolt 130 is made from metal and/or a metallic material. In other examples, the barrel extension 115 is made from metal and/or a metallic material. In yet other examples, the barrel extension 115 and the bolt 130 are made from the same material. However, in other examples, the barrel extension 115 and the bolt 130 are made from different materials.

Figure 10:
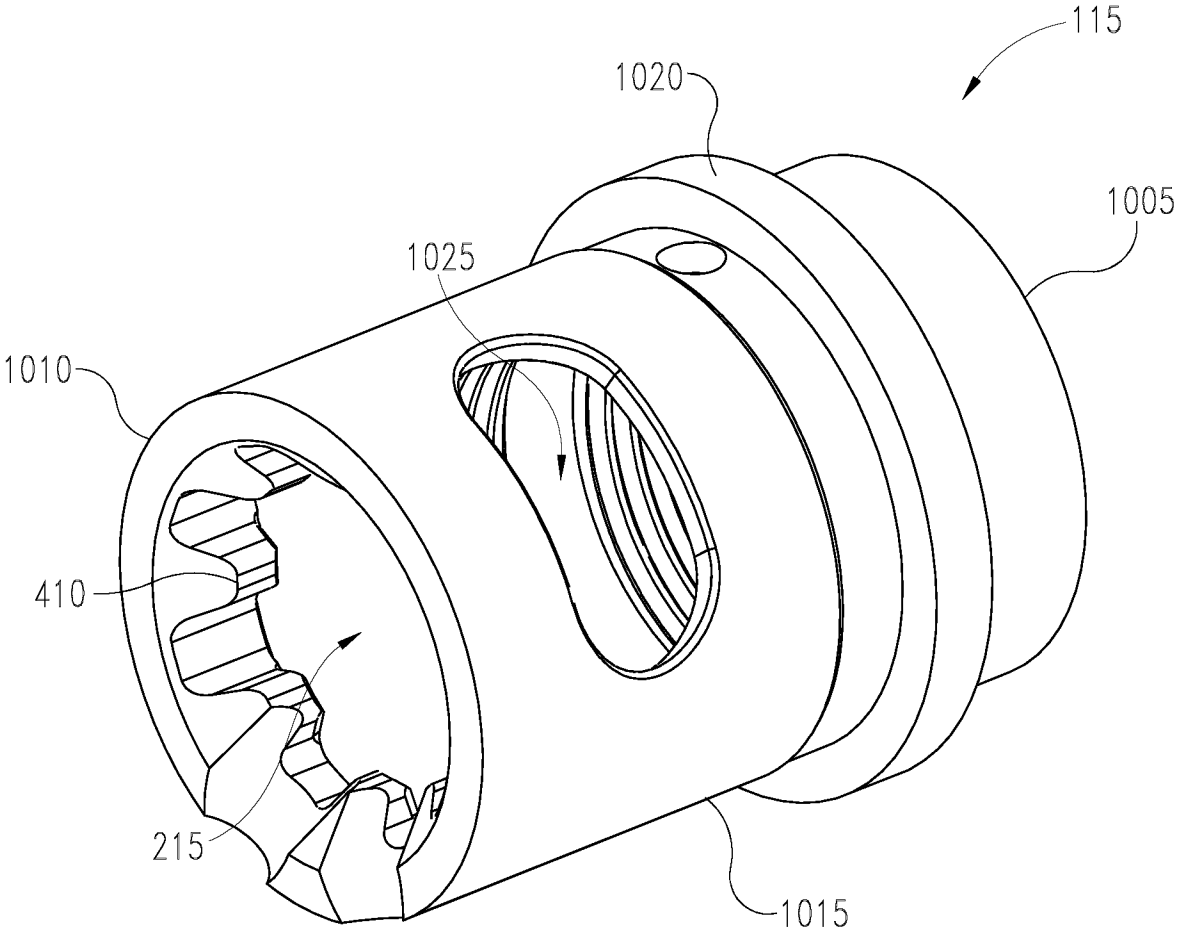
FIG. 10 is a perspective view of a barrel extension of the breech assembly of FIG. 2.

FIG. 10 shows an example of the barrel extension 115. The barrel extension 115 includes a barrel engagement end 1005 and a bolt engagement end 1010 defining a body 1015. The body 1015 includes a circumferential ridge 1020 configured to sandwich between an upper receiver of the firearm 100 and a barrel nut in order to mount the barrel 105 to the firearm 100. In one example, the body 1015 of the barrel extension 115 defines a cylindrical shape. However, in other examples, the body 1015 is cubical and/or another polygonal shape. The body 1015 further defines a cutout 1025. The cutout 1025 is configured to reduce rigidity of the barrel extension 115 proximal to the cutout 1025. As should be appreciated, reducing rigidity of the barrel extension 115 reduces the amount of force on the lugs 405 of the bolt 130. Thus, more evenly distributing force to each of the lugs 405 and reducing the risk of bolt failure.

Figure 11:
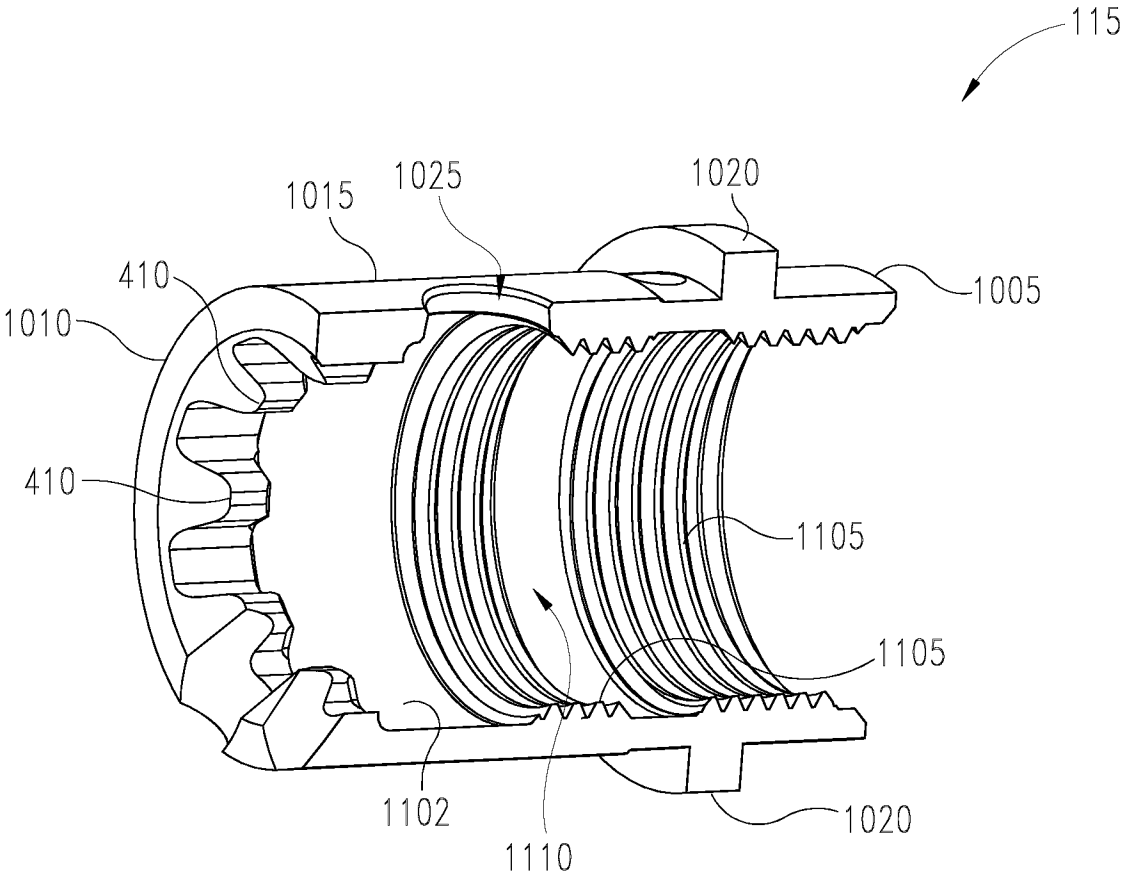
FIG. 11 is a cross-sectional view of the barrel extension of FIG. 10.

FIG. 11 shows a cross-sectional view of the barrel extension 115. The body 1015 of the barrel extension 115 defines an inner surface 1102 with one or more threads 1105. The threads 1105 are configured to interact with the breech end 112 of the barrel 105 to secure the barrel extension 115 to the barrel 105. The threaded connection between the barrel extension 115 and the barrel 105 enables a user to remove the barrel extension 115 from the barrel 105. For example, a user may remove the barrel extension 115 from the barrel 105 to replace the barrel extension 115 and/or perform maintenance on the firearm 100. The inner surface 1102 further defines a chamber 1110 and/or "star chamber" configured to retain the bolt head 210 and cartridge when in the locked position 300.

Figure 12:
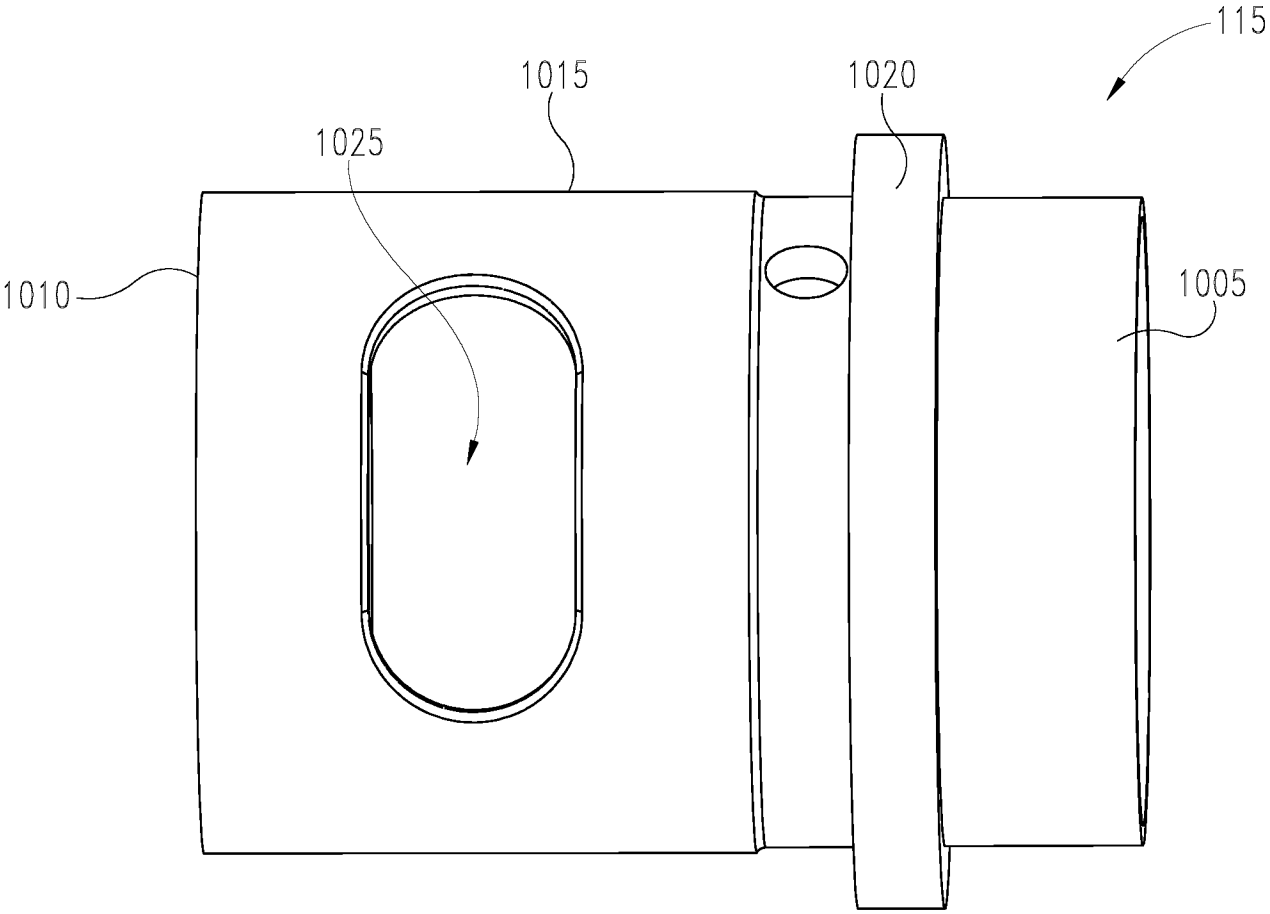
FIG. 12 is a side view of the barrel extension of FIG. 10.

FIG. 12 shows another view of the barrel extension 115. In one example, the cutout 1025 defines an oval shape. In another example, the cutout 1025 is located adjacent the extractor 725 when in the locked position 300. Orientation of the cutout 1025 adjacent the extractor 725 is configured to reduce stress on the lugs 405 adjacent the extractor 725. As should be appreciated, the cutout 1025 is configured to create a higher stress concentration around the perimeter of the cutout 1025. The increased stress around the cutout 1025 reduces the tensile load carrying capacity of the barrel extension 115. The reduced load carrying capacity translates to a strategically weaker barrel extension 115 in an area around the cutout 1025. Weakening the barrel extension 115 adjacent the extractor 725 helps to prevent shearing off of the lugs 405 from the bolt 130 during firing. For example, during firing, combustion within the breech 120 applies rearward pressure to the bolt face 715. The rearward pressure is concentrated on the lugs 405 of the bolt 130, thus leading to premature failure of the bolt 130.

In other embodiments, there is more than one cutout 1025. For example, the cutout 1025 includes a pair of cutouts 1025 adjacent the extractor 725. In yet another example, the cutouts 1025 define a rectangular and/or other polygonal shape. In other embodiments, the cutout 1025 is positioned in other areas of the body 1015 to mitigate stress on the lugs 405. Thus, the barrel extension 115 can be specifically tailored to different firearm calibers, cartridge pressures, and/or different bolt configurations based on the size, shape, and/or location of the cutout 1025.

Figure 13:
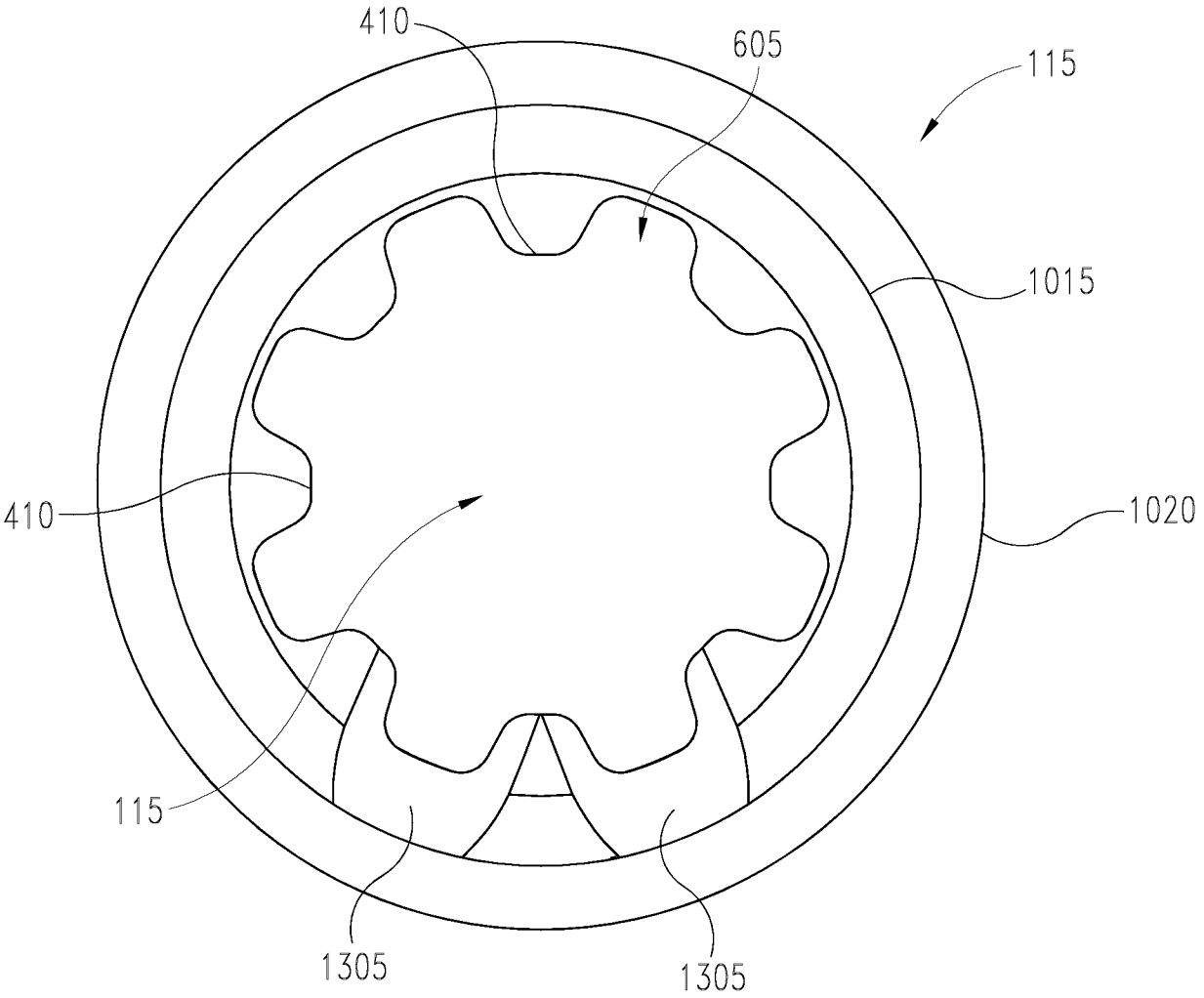
FIG. 13 is an enlarged end view of the barrel extension of FIG. 10.

FIG. 13 shows an end view of the barrel extension 115. The barrel extension 115 includes one or more chamfered edges 1305 leading into one or more of the notches 605. The chamfered edges 1305 are configured to serve as a ramp and/or guide for the lugs 405. For example, the chamfered edges 1305 guide the lugs 405 into the opening 215 to assure proper alignment of the lugs 405 and the teeth 410.

Figure 14:
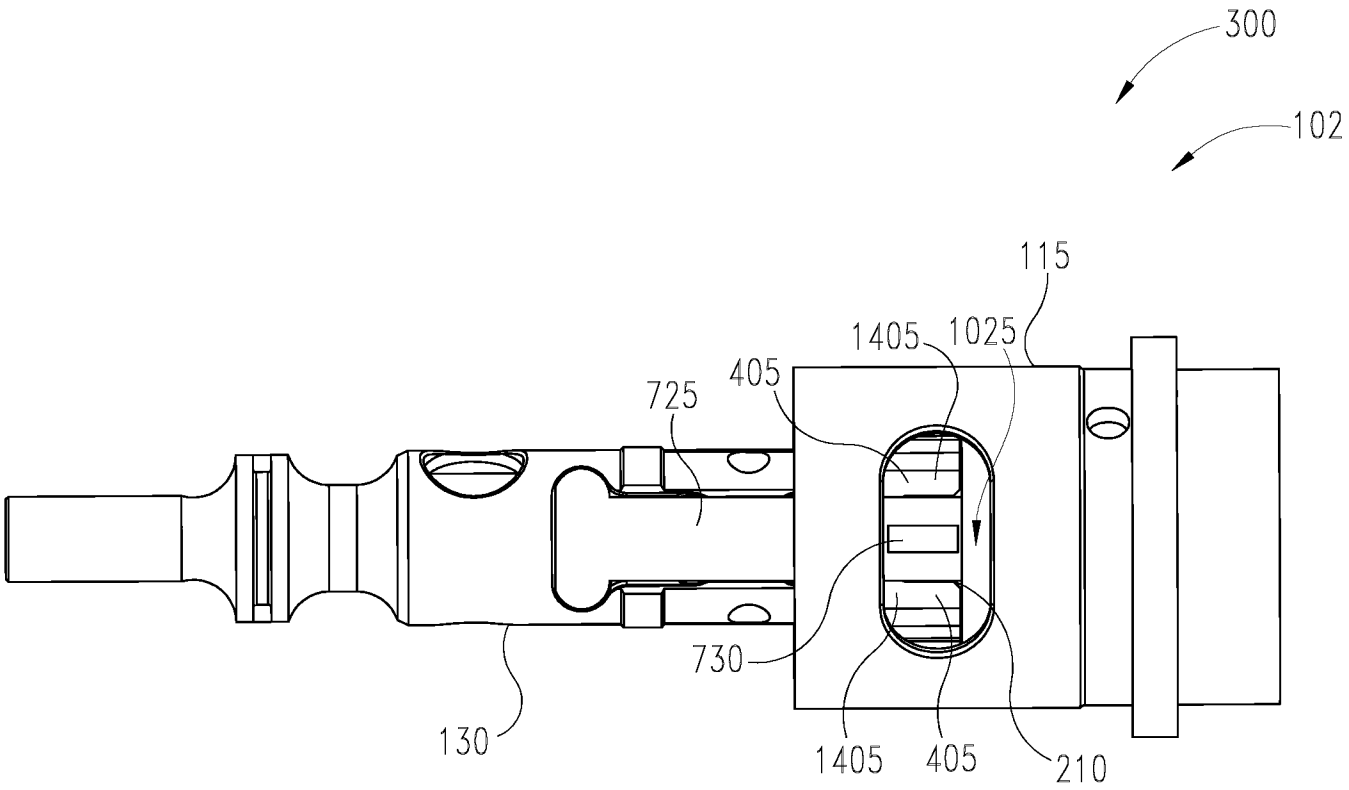
FIG. 14 is a top view of the breech assembly of FIG. 3.

FIG. 14 shows an example of the breech assembly 102 in the locked position 300. In the locked position 300, the bolt 130 is arranged within the barrel extension 115 such that the extractor lug 730 aligns with the cutout 1025. In one example, the extractor lug 730 is configured to align with a center of the cutout 1025. The cutout 1025 is sized such that one or more channel lugs 1405 are arranged adjacent the cutout 1025. Typically, the channel lugs 1405, which are arranged on either side of the extractor 725, are most likely to fail and/or shear off of the bolt 130 during catastrophic failure of the bolt 130. Thus, strategically aligning the cutout 1025 adjacent the channel lugs 1405 weakens the barrel extension 115 around the channel lugs 1405. As should be appreciated, weakening the barrel extension 115 adjacent the channel lugs 1405 reduces the risk of failure of the channel lugs 1405 and increases the lifespan of the bolt 130. In other examples, the cutout 1025 is in the form of a pair of cutouts 1025 arranged directly over the channel lugs 1405 in order to mitigate failure of the bolt 130.

Figure 15:
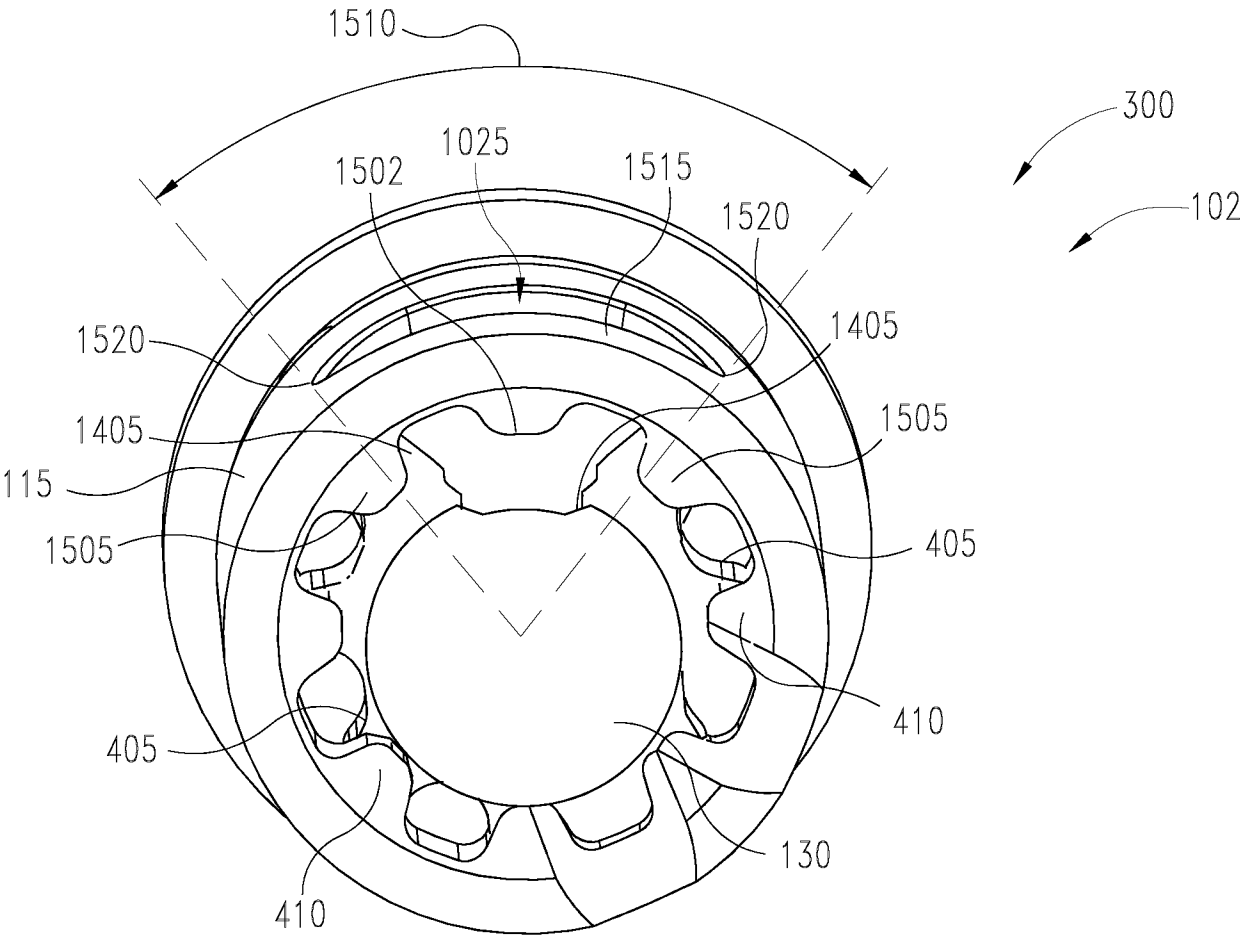
FIG. 15 is a rear perspective view of a portion of the breech assembly of FIG. 3 in the locked position.

FIG. 15 shows another example of the arrangement of the cutout 1025. In one example, the cutout 1025 is arranged directly over an extractor tooth 1502 of the barrel extension 115. The extractor tooth 1502 is configured to engage with the extractor lug 730 of the extractor 725 when in the locked position 300. The cutout 1025 has one or more ends 1520 configured to align with one or more channel teeth 1505 of the barrel extension 115. The channel teeth 1505 are configured to interact and/or lock with the channel lugs 1405 of the bolt 130 when in the locked position 300. The channel teeth 1505 are configured to elastically deform and/or flex during firing of the firearm 100 in order to more evenly distribute force across the lugs 405 of the bolt 130. The channel teeth 1505 are configured to deform and/or flex due to a flex band 1515 located adjacent the channel teeth 1505. The flex band 1515 is located between the cutout 1025 and the bolt engagement end 1010 of the barrel extension 115. The flex band 1515 is weakened by the cutout 1025, such that the flex band 1515 is configured to deform and/or flex during firing of the firearm 100. As should be appreciated, deformation of the flex band 1515 enables deformation of the channel teeth 1505, thus lowering the force on the channel lugs 1405 and more evenly distributing force across the lugs 405 of the bolt 130. Mitigating the amount of force on the channel lugs 1405, which is the most common failure point on the bolt 130, reduces the risk of failure of the bolt 130.

In one embodiment, the alignment of the center of the channel teeth 1505 and the ends 1520 of the cutout 1025 defines an angle 1510 with respect to a center of the bolt 130. In one example, the angle 1510 is 45 degrees such that the center of the channel teeth 1505 aligns with the ends 1520 of the cutout 1025 and the extractor tooth 1502 aligns with the center of the cutout 1025. In other examples, the angle 1510 is greater than 45 degrees. In yet another example, the angle 1510 is less than 45 degrees. The cutout 1025 is arranged adjacent the channel lugs 1405 of the bolt 130 such that the force on the channel lugs 1405 is mitigated. However, as should be appreciated, the channel teeth 1505 can be any one or more of the teeth 410 depending on the location of the cutout 1025.

As mentioned previously, deformation and/or flex in the channel teeth 1505 and the flex band 1515 enables force and/or stress as a result of operation of the firearm 100 to more evenly distribute across the lugs 405 of the bolt 130, thus lowering the force on the channel lugs 1405. As mentioned previously, the channel lugs 1405 are most likely to shear off and/or fail during operation of the firearm 100, thus the cutout 1025 is strategically placed adjacent the extractor 725 to mitigate the risk of failure of the bolt 130.

Figure 16:
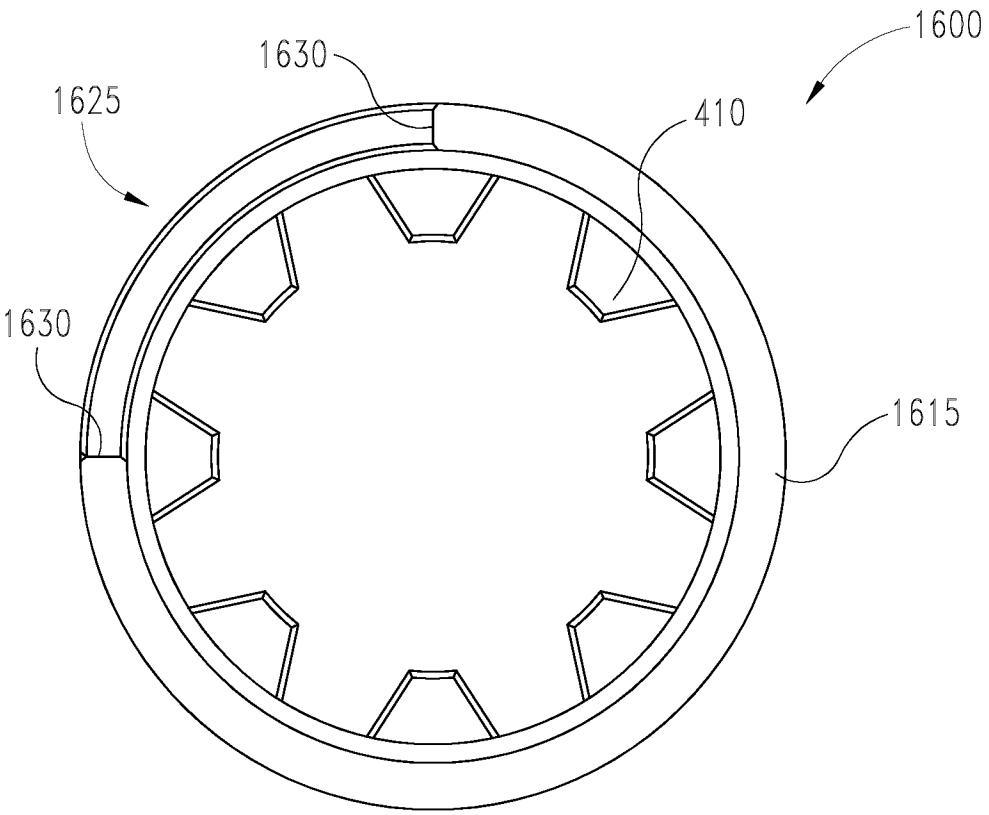
FIG. 16 is a cross-sectional view of another embodiment of a barrel extension.

FIG. 16 shows an example of a barrel extension 1600. The barrel extension 1600 includes a body 1615 with one or more cutouts 1625. In one example, the cutout 1625 includes one or more straight walls 1630. The straight walls 1630 of the cutout 1625 are configured generate a predetermined force mitigation response in the barrel extension 1600 to reduce the amount of stress on the bolt 130 and the barrel extension 1600 during firing of the firearm. In one example, the straight walls 1630 form a roughly 90 degree angle with respect to the body 1615. As should be appreciated, the barrel extension 1600 is configured to enable the use of higher pressure rounds, such as +P or similar rounds, without an increased risk of mechanical failure of the bolt 130 and/or barrel extension 1600.

Figure 17:
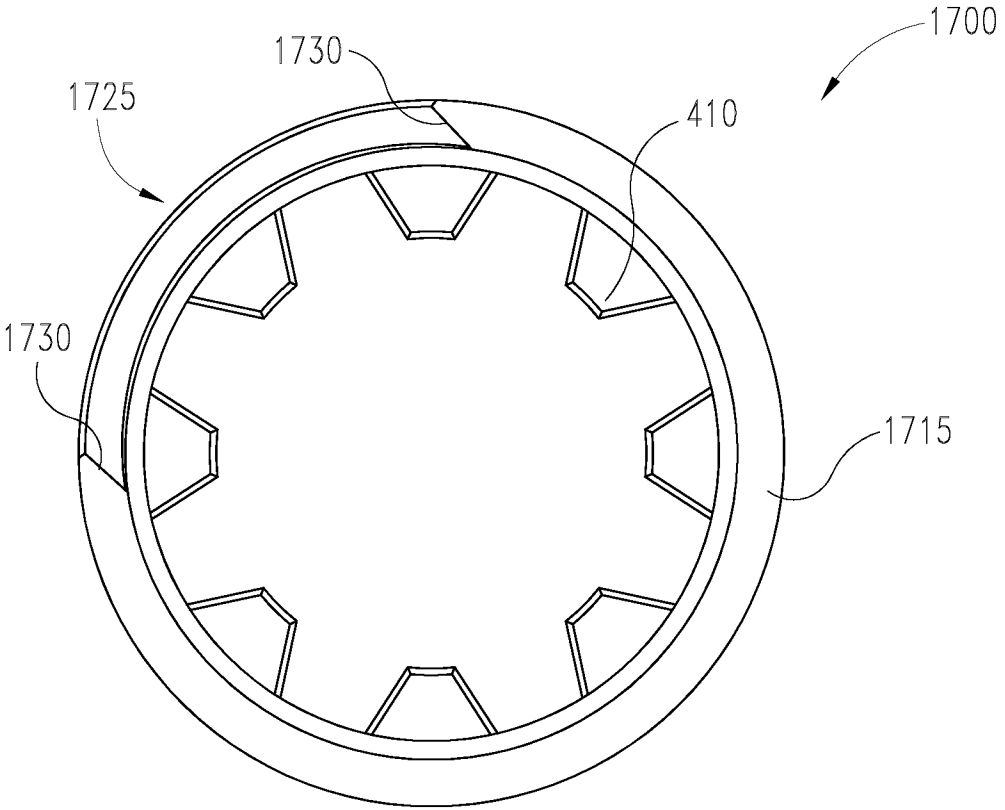
FIG. 17 is a cross-sectional view of yet another embodiment of a barrel extension.

FIG. 17 shows an example of a barrel extension 1700. The barrel extension 1700 includes a body 1715 with one or more cutouts 1725. In one example, the cutout 1725 includes one or more angled walls 1730. The angled walls 1730 of the cutout 1725 are configured generate a predetermined force mitigation response in the barrel extension 1700 to reduce the amount of stress on the bolt 130 and the barrel extension 1700 during firing of the firearm. In one example, the angled walls 1730 form a roughly 45 degree angle with respect to the body 1715. In another example, the angled walls 1730 form an angle between 10 degrees and 80 degrees with respect to the body 1715. The angled walls 1730 are further configured to assist in the dispersing of combustion gasses following a shot. As should be appreciated, the barrel extension 1700 is configured to enable the use of higher pressure rounds, such as +P or similar rounds, without an increased risk of mechanical failure of the bolt 130 and/or barrel extension 1700.

Figure 18:
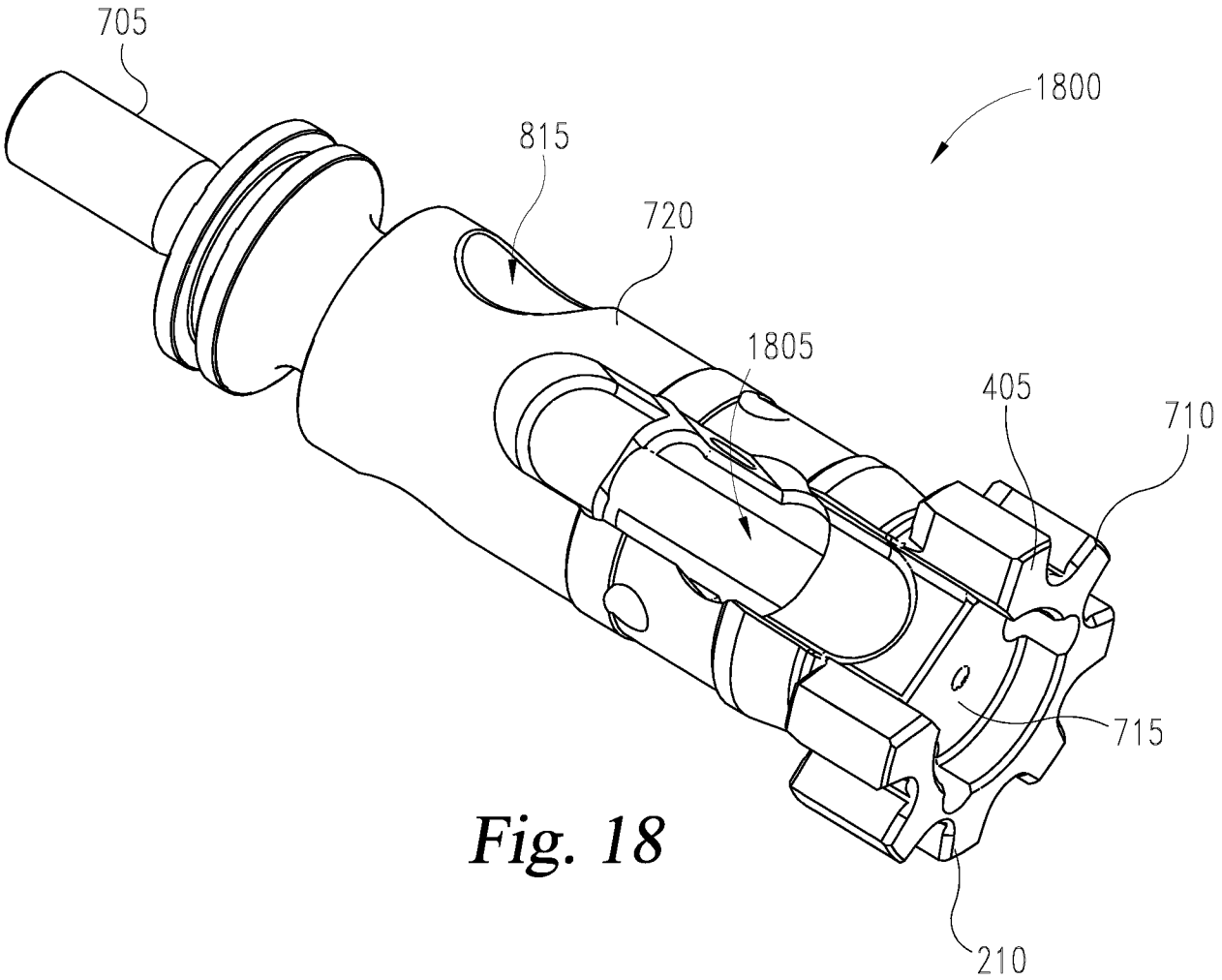
FIG. 18 is a perspective view of another embodiment of a bolt.

FIG. 18 shows an example of a bolt 1800. The bolt 1800 includes many of the same components as the bolt 130 described previously in FIG. 8. However, the bolt 1800 does not include the one or more apertures 810. Instead, the bolt 1800 includes a channel 1805 free from the one or more apertures 810. The bolt 1800 is configured to work with a variety of automatic, semi-automatic, select fire, and other firearms.

Glossary of Terms

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to these terms and common variations thereof identified below.

"About" with reference to numerical values generally refers to plus or minus 10% of the stated value. For example, if the stated value is 4.375, then use of the term "about 4.375" generally means a range between 3.9375 and 4.8125.

"Acute" or "Acute Angle" generally refers to an angle smaller than a right angle or less than 90 degrees.

"And/Or" generally refers to a grammatical conjunction indicating that one or more of the cases it connects may occur. For instance, it can indicate that either or both of two stated cases can occur. In general, "and/or" includes any combination of the listed collection. For example, "X, Y, and/or Z" encompasses: any one letter individually (e.g., {X}, {Y}, {Z}); any combination of two of the letters (e.g., {X, Y}, {X, Z}, {Y, Z}); and all three letters (e.g., {X, Y, Z}). Such combinations may include other unlisted elements as well.

"Barrel" generally refers to a cylindric tube through which a projectile travels after a shot from a firearm. The barrel is generally made from metal and/or a metallic material. However, some barrels are made from a polymeric material, such as carbon fiber. The barrel includes a hollow interior portion known as the bore, which corresponds to a caliber and/or projectile diameter for the firearm. For example, a larger projectile (bullet) requires a larger diameter bore and a smaller projectile requires a smaller diameter bore. The diameter of the bore is configured to correspond with a diameter of the projectile. For example, the bore may range from 0.51 inches (13 mm) to 0.172 inches (4.5 mm). The bore may be smooth and/or rifled. The barrel further includes a breech end and a muzzle end. The breech end is proximal the shooter during firing and the muzzle end is distal the shooter when firing. Generally, a projectile is loaded into the barrel at the breech end and is discharged from the firearm at the muzzle end.

"Barrel Extension" generally refers to a component fixed to a rear and/or breech facing end of a barrel. The barrel extension is configured to hold the breech closed and/or locked against gas pressure during firing of a firearm. In some examples, the barrel extension includes one or more teeth configured to interlock with one or more lugs of a bolt to lock the bolt and barrel extension together.

"Bolt" generally refers to a component of a repeating, breechloading firearm that blocks the rear opening (breech) of a barrel chamber during firing. The bolt is configured to reciprocate in order to facilitate loading and/or unloading of cartridges from the firearm. In some examples, the bolt includes one or more lugs configured to interlock with a barrel extension to lock the bolt in position during firing. The bolt further includes a firing pin and/or an extractor. In some examples, bolts are held within a bolt carrier group of the firearm. In other examples, the bolt is configured to rotate between 270 and 0 degrees to lock and/or unlock the bolt from the barrel extension.

"Channel" generally refers to a long, narrow groove in a surface of an object.

"Elastic Deformation" generally refers to a temporary change in length, volume, shape, and/or other material characteristic produced in an elastic substance by a stress and/or load that is less than an elastic limit of the substance. Elastic deformation is typically temporary and the material will generally revert back to the material's pre-deformation shape, length, and/or volume after the stress and/or external force is removed.

"Fastener" generally refers to a hardware device that mechanically joins or otherwise affixes two or more objects together. By way of non-limiting examples, the fastener can include bolts, dowels, nails, nuts, pegs, pins, rivets, screws, buttons, hook and loop fasteners, and snap fasteners, to just name a few.

"Firearm" generally refers to any device that can be used to and/or converted to expel a projectile via an explosion. For example, firearms include pistols, rifles, shotguns, muzzleloaders, carbines, machine guns, sniper rifles, submachine guns, assault rifles, automatic rifles, semiautomatic rifles, flare guns, starter guns, and/or other devices. In another example, a firearm may have different actions, such as lever action, pump action, manual, semiautomatic, automatic, selective fire, single action, double action, hammer fired, and/or other actions.

"Integrally Formed" generally refers to a component and/or multiple components that are fused into a single piece. Integrally formed components are incapable of being dismantled without destroying the integrity of the component.

"Load Capacity" generally refers to the maximum ability of a member and/or material to take loading before failure occurs. For example, before bending and/or other failure occurs. Load capacities are generally material dependent and vary with materials and/or material shapes.

"Metallic" generally refers to a material that includes a metal, or is predominately (50% or more by weight) a metal. A metallic substance may be a single pure metal, an alloy of two or more metals, or any other suitable combination of metals. The term may be used to refer to materials that include nonmetallic substances. For example, a metallic cable may include one or more strands of wire that are predominately copper sheathed in a polymer or other non-conductive material.

"Notch" generally refers to an indentation, cut, groove, channel, and/or incision on an edge or surface. In some non-limiting examples, the notch includes a V-shaped or U-shaped indentation carved, scratched, etched, stamped, and/or otherwise formed in the edge or surface. The notch can have a uniform shape or a non-uniform shape.

"Positive Lock" generally refers to a type fastening structure that is configured to remain secured even under vibratory or other loads.

"Projectile" generally refers to an object propelled by the application of an external force. For example, a firearm is configured to fire projectiles in the form of bullets, shells, slugs, balls, and/or other objects.

"Rotate" generally refers to turning or movement about an axis and/or center. In some examples, the axis and/or center may be a fixed point. A more technical definition may include, to cause a plane region, line, and/or object to sweep out a volume or surface by moving around an axis so that each of its points remain at a constant distance from the axis. As an example, the earth rotates about a center axis. As another example, a pin joint allows movement via rotation about a single axis formed by the pin.

"Tensile Load" generally refers to the ratio of the applied force divided by the unit area that tends to elongate or stretch a material. Tensile load, which tends to increase the length of a material, is the opposite of compression, which tends to reduce the length of a material. Tensile load is also called tensile stress.

"Unitary" means here a single, continuous entity formed without multiple pieces.

It should be noted that the singular forms "a," "an," "the," and the like as used in the description and/or the claims include the plural forms unless expressly discussed otherwise. For example, if the specification and/or claims refer to "a device" or "the device", it includes one or more of such devices.

It should be noted that directional terms, such as "up," "down," "top," "bottom," "lateral," "longitudinal," "radial," "circumferential," "horizontal," "vertical," etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by the following claims are desired to be protected. All publications, patents, and patent applications cited in this specification are herein incorporated by reference as if each individual publication, patent, or patent application were specifically and individually indicated to be incorporated by reference and set forth in its entirety herein.

Part Reference Numbers

100 firearm
102 breech assembly
105 barrel
110 bore
112 breech end
115 barrel extension
120 breech
125 bolt carrier
130 bolt
135 gas key
140 cam pin
202 unlocked position
205 arrow
210 bolt head
215 opening
300 locked position
305 arrow
405 lugs
410 teeth
415 positive lock
505 engagement face
510 locking face
515 arrow
605 notches
705 bolt carrier end
710 barrel extension end
715 bolt face
720 body
725 extractor
730 extractor lug
805 channel
810 apertures
815 slot
905 grooves
1005 barrel engagement end
1010 bolt engagement end
1015 body
1020 ridge
1025 cutout
1102 inner surface
1105 threads

1110 chamber
1305 chamfered edges
1405 channel lugs
1502 extractor tooth
1505 channel teeth
1510 angle
1515 flex band
1520 ends
1600 barrel extension
1615 body
1625 cutout
1630 straight walls
1700 barrel extension
1715 body
1725 cutout
1730 angled walls
1800 bolt
1805 channel

What is claimed is:

1. A system, comprising:
a bolt having one or more lugs;
wherein the bolt has an extractor;
a barrel extension having one or more teeth configured to engage the lugs of the bolt;
wherein the barrel extension has one or more weakened areas configured to reduce a risk of shearing at least one of the lugs of the bolt; and
wherein the weakened areas are positioned on the barrel extension to even out an uneven shear stress distribution on the lugs created by the extractor on the bolt.

2. The system of claim 1, wherein the weakened areas are configured to reduce the rigidity of the barrel extension proximal to the lugs of the bolt.

3. The system of claim 1, wherein the weakened areas include one or more cutouts in the barrel extension.

4. The system of claim 3, wherein the cutouts have an oval shape.

5. The system of claim 4, wherein the cutouts are positioned proximal to at least one extractor lug of the bolt.

6. The system of claim 3, wherein the cutouts include a pair of cutouts.

7. The system of claim 6, wherein the cutouts are positioned proximal to a pair of lugs of the bolt located adjacent an extractor lug of the bolt.

8. The system of claim 1, wherein the barrel extension includes one or more chamfered edges configured to guide the bolt into the barrel extension.

9. The system of claim 3, wherein the cutouts are configured to make the barrel extension have an asymmetric rigidity relative to a longitudinal axis of the barrel extension.

10. A system comprising:
a bolt having one or more lugs;
a barrel extension having one or more teeth configured to engage the lugs of the bolt;
wherein the barrel extension has one or more weakened areas configured to reduce a risk of shearing at least one of the lugs of the bolt;
wherein the weakened areas are configured to reduce the rigidity of the barrel extension proximal to the lugs of the bolt;
wherein the weakened areas are configured to reduce shear force on the lugs of the bolt proximal to an extractor during firing; and
wherein the weakened areas are configured to evenly distribute the shear force to each lug of the bolt.

11. The system of claim 10, wherein the weakened areas include one or more cutouts in the barrel extension.

12. The system of claim 11, wherein the cutouts have an oval shape.

13. The system of claim 11, wherein the cutouts include a pair of cutouts.

14. The system of claim 11, wherein the cutouts are configured to make the barrel extension have an asymmetric rigidity relative to a longitudinal axis of the barrel extension.

15. A breech assembly, comprising:
a barrel having a breech end;
a barrel extension removably mounted to the breech end of the barrel;
a bolt configured to selectively engage with the barrel extension during operation of a firearm;
wherein the barrel extension defines one or more cutouts configured to decrease a risk of failure of the bolt;
wherein the bolt defines a channel;
wherein the bolt has a channel lug positioned along the channel;
wherein the barrel extension has a channel tooth that is positioned to engage the channel lug;
wherein the barrel extension has a flex band that is weakened by at least one of the cutouts; and
wherein the flex band is configured to deform to lower force on the channel tooth during firing.

16. The breech assembly of claim 15, wherein the cutouts are configured to make the barrel extension have an asymmetric rigidity relative to a longitudinal axis of the barrel extension.

17. The breech assembly of claim 15, wherein the cutouts have an oval shape.

18. The breech assembly of claim 17, wherein:
the bolt has at least one extractor lug; and
the cutouts are positioned proximal to the extractor lug.

19. The breech assembly of claim 15, wherein the cutouts include a pair of cutouts.

20. A breech assembly comprising:
a barrel having a breech end;
a barrel extension removably mounted to the breech end of the barrel;
a bolt configured to selectively engage with the barrel extension during operation of a firearm;
wherein the barrel extension defines one or more cutouts configured to decrease a risk of failure of the bolt;
wherein the bolt defines a channel;
an extractor received in the channel of the bolt;
wherein the bolt has a pair of lugs located on opposite sides of the channel; and
wherein the cutouts are positioned to face the channel in the bolt.

21. The breech assembly of claim 20, wherein:
the cutouts include a single cutout; and
the single cutout spans across the pair of lugs.

22. The breech assembly of claim 20, wherein the cutouts have an oval shape.

23. The breech assembly of claim 20, wherein the cutouts include a pair of cutouts.

24. The breech assembly of claim 20, wherein the cutouts are configured to make the barrel extension have an asymmetric rigidity relative to a longitudinal axis of the barrel extension.

25. A breech assembly comprising:
a barrel having a breech end;
a barrel extension removably mounted to the breech end of the barrel;
a bolt configured to selectively engage with the barrel extension during operation of a firearm;

wherein the barrel extension defines one or more cutouts configured to decrease a risk of failure of the bolt; and wherein the cutouts are configured to evenly distribute shear force to each lug of the bolt.

26. The breech assembly of claim 25, wherein the cutouts are configured to make the barrel extension have an asymmetric rigidity relative to a longitudinal axis of the barrel extension.

27. The breech assembly of claim 25, further comprising:

wherein the bolt defines a channel;

an extractor received in the channel of the bolt;

wherein the bolt has a pair of lugs located on opposite sides of the channel; and wherein the cutouts are positioned to face the channel in the bolt.

28. The breech assembly of claim 27, wherein:

the cutouts include a single cutout; and the single cutout spans across the pair of lugs.

29. The breech assembly of claim 25, wherein the cutouts have an oval shape.

30. The breech assembly of claim 29, wherein:

the bolt has at least one extractor lug; and the cutouts are positioned proximal to the extractor lug.

31. The breech assembly of claim 25, wherein the cutouts include a pair of cutouts.

32. A breech assembly comprising:

a barrel having a breech end;

a barrel extension removably mounted to the breech end of the barrel;

a bolt configured to selectively engage with the barrel extension during operation of a firearm;

wherein the barrel extension defines one or more cutouts configured to decrease a risk of failure of the bolt;

wherein the cutouts include a pair of cutouts;

wherein the bolt has an extractor;

wherein the extractor has an extractor lug;

wherein the bolt has a pair of lugs located adjacent the extractor lug; and wherein the cutouts are positioned proximal to the pair of lugs of the bolt.

33. The breech assembly of claim 32, wherein the cutouts have an oval shape.

34. The breech assembly of claim 32, wherein the cutouts are configured to make the barrel extension have an asymmetric rigidity relative to a longitudinal axis of the barrel extension.

* * * * *